US010522088B2

(12) United States Patent
Kato

(10) Patent No.: US 10,522,088 B2
(45) Date of Patent: Dec. 31, 2019

(54) SIGNAL PROCESSING CIRCUIT, DISPLAY DEVICE, AND RECORDING MEDIUM

(71) Applicant: JOLED INC., Tokyo (JP)

(72) Inventor: Toshiyuki Kato, Tokyo (JP)

(73) Assignee: JOLED INC., Tokyo (JP)

( * ) Notice: Subject to any disclaimer, the term of this patent is extended or adjusted under 35 U.S.C. 154(b) by 43 days.

(21) Appl. No.: 16/009,671

(22) Filed: Jun. 15, 2018

(65) Prior Publication Data

US 2019/0027097 A1 Jan. 24, 2019

(30) Foreign Application Priority Data

Jul. 24, 2017 (JP) ..... 2017-142404

(51) Int. Cl.
*G09G 3/32* (2016.01)
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2310/0202* (2013.01);
(Continued)

(58) Field of Classification Search
CPC ..... G09G 2320/0233; G09G 2320/043; G09G 2320/045; G09G 2320/029; G09G 2320/0646; G09G 2310/024; G09G 2320/0252; G09G 2320/048; G09G 2320/046; G09G 2320/0693; G09G 2300/0861; G09G 2320/0257; G09G 2320/06; G09G 2320/064; G09G 2320/0653; H04N 5/2256; H04N 1/4074; H04N 1/00037; H04N 1/00068; H04N 1/00737; G06K 9/00463; G06K 9/34; G06K 9/6212; G06K 9/68; G06K 9/00228
(Continued)

(56) References Cited

U.S. PATENT DOCUMENTS

2008/0224966 A1* 9/2008 Cok ..... G09G 3/32 345/82
2008/0231557 A1* 9/2008 Naugler ..... G09G 3/3225 345/76
(Continued)

FOREIGN PATENT DOCUMENTS

WO 2008/152817 12/2008

*Primary Examiner* — Duc Q Dinh
(74) *Attorney, Agent, or Firm* — Greenblum & Bernstein P.L.C.

(57) ABSTRACT

A signal processing circuit includes an accumulator circuit that accumulates display history information regarding light-emitting devices, and a detection circuit that detects the degree of deterioration of a display panel by the accumulated display history information and detects a rotation-recommended state of the display panel on the basis of the degree of deterioration. In the case where the display panel is divided into a plurality of blocks each including the same number of pixel circuits, the detection circuit detects the degree of deterioration for each of the blocks, and if the number of the blocks whose degrees of deterioration are greater than or equal to a first threshold value determined in advance is greater than or equal to a predetermined number, detects that the display panel is in the rotation-recommended state.

14 Claims, 8 Drawing Sheets

(52) U.S. Cl.
CPC ..... *G09G 2320/0233* (2013.01); *G09G 2320/046* (2013.01)

(58) Field of Classification Search
USPC ..... 345/76–84
See application file for complete search history.

(56) References Cited

U.S. PATENT DOCUMENTS

| | | | | |
|---|---|---|---|---|
| 2010/0007645 | A1 | 1/2010 | Ono | |
| 2016/0210903 | A1* | 7/2016 | Jun | G09G 3/3266 |

* cited by examiner

SIGNAL PROCESSING CIRCUIT, DISPLAY DEVICE, AND RECORDING MEDIUM

CROSS REFERENCE TO RELATED APPLICATION

The present application is based on and claims priority of Japanese Patent Application No. 2017-142404 filed on Jul. 24, 2017. The entire disclosure of the above-identified application, including the specification, drawings and claims is incorporated herein by reference in its entirety.

FIELD

The present disclosure relates to a signal processing circuit, a display device, and a recording medium.

BACKGROUND

Image display devices (organic electroluminescent (EL) displays) using organic EL devices (e.g., organic light emitting diodes; OLEDs) are, for example, known as display devices. The organic EL displays are receiving attention as candidates for the next-generation flat panel displays (FPDs) because of their advantages of having good viewing angle characteristics and consuming less power.

There is a phenomenon in which the light emission luminance of light-emitting devices such as organic EL devices for the same voltage decreases due to deterioration over time after long-term use. In view of this, the display devices including light-emitting devices introduce techniques for suppressing a decrease in luminance or suppressing burn-in by controlling a driving voltage in an image signal processing circuit that uses display history information for each pixel or for each display area (see PTL 1, for example).

According to the technique disclosed in PTL 1, a threshold-value (Vth) compensation circuit is formed in the pixels of a display device to suppress variations in the characteristics of driving transistors and thereby to suppress unevenness in luminance for each pixel or for each display area, which may be caused by a decrease in the luminance of light-emitting devices and burn-in.

CITATION LIST

Patent Literature

[PTL 1] International Publication WO/2008/152817

SUMMARY

Technical Problem

The correction method disclosed in PTL 1 attempts to suppress unevenness in the luminance of a display device by using the Vth compensation circuit formed in the pixels to suppress Vth variations in the initial TFT characteristics of the driving transistors and Vth variations caused by deterioration over time.

However, display screens of personal computers such as those used for paperwork tasks or game purposes always display icons or information at specific positions thereon. Thus, light-emitting devices disposed at the specific positions will deteriorate more quickly over time than other light-emitting devices disposed at the other positions. Accordingly, the light-emitting devices disposed at the specific positions have shorter lifetimes than the light-emitting devices disposed at the other positions, i.e., have shorter periods until a limit is reached at which it is no longer possible to resolve unevenness in the luminance of the light-emitting devices caused by a decrease in luminance and burn-in. For this reason, there is the problem that the overall lifetime of the display device is shortened.

In view of the problem described above, it is an object of the present disclosure to provide a signal processing circuit capable of prolonging the lifetime of a display device, a recording medium, and a display device with a prolonged lifetime.

Solution to Problem

In order to achieve the object described above, a signal processing circuit according to an aspect of the present disclosure is a signal processing circuit for a display panel in which a plurality of pixel circuits each including a light-emitting device are arranged in rows and columns. The signal processing circuit includes an accumulator circuit that accumulates display history information regarding the light-emitting devices, and a detection circuit that detects a degree of deterioration of the display panel from the display history information accumulated, and detects a rotation-recommended state of the display panel on the basis of the degree of deterioration. The detection circuit is configured to, in a case where the display panel is divided into a plurality of blocks each having the same number of pixel circuits, detect the degree of deterioration for each of the plurality of blocks, and if the number of the plurality of blocks whose degrees of deterioration are greater than or equal to a first threshold value determined in advance is greater than or equal to a predetermined number, detect that the display panel is in the rotation-recommended state.

With this configuration, the display panel is rotated before a limit is reached at which it is no longer possible to resolve a decrease in the luminance of light-emitting devices by correcting the luminance. Thus, it is possible, by correcting the light emission luminance of deteriorated light-emitting devices, to cause the light-emitting devices to emit light at proper luminance and display images. This prolongs the lifetime of the display device.

Also, the detection circuit may include a maximum value detector that detects, as the degree of deterioration, a maximum value of accumulated values of the display history information regarding the light-emitting devices for each of the plurality of blocks.

With this configuration, the rotation-recommended state can be detected with high accuracy, because a maximum value of the accumulated values of the display history information regarding the light-emitting devices for each of the plurality of blocks is detected as the degree of deterioration.

Also, the detection circuit may include a determination part that calculates, as the degree of deterioration, an average value of a first degree of deterioration for each of the plurality of blocks and a second degree of deterioration for each of the plurality of blocks that overlap respectively with positions of the plurality of blocks when the display panel is rotated in an in-plane direction, and determines whether the average value calculated is less than or equal to a second threshold value.

With this configuration, in which an average value of the degrees of deterioration before and after rotation of the display panel is calculated, it is possible to predetermine whether a decrease in the luminance of light-emitting devices in a predetermined block can be resolved by rotating the display panel. This increases the efficiency of rotating the display panel.

In a case where the detection circuit has detected that the display panel is in the rotation-recommended state, and the display panel is rotated, the detection circuit may operate a gate driving circuit that outputs a gate signal is operated to change an order in which the gate signal is output to the plurality of pixel circuits arranged in a column direction on the display panel from a first direction to a second direction opposite to the first direction, and a source driving circuit that outputs an image signal is operated to change an order in which the image signal is output to the plurality of pixel circuits arranged in a row direction on the display panel from a third direction orthogonal to the first direction to a fourth direction opposite to the third direction.

With this configuration, an image can be displayed in a proper orientation on the display panel when the display panel is rotated.

In order to achieve the object described above, a display device according to another aspect of the present disclosure includes a display panel in which a plurality of pixel circuits each including a light-emitting device are arranged in rows and columns, a source driving circuit that supplies an image signal that is displayed on the display panel to the pixel circuits, a gate driving circuit that supplies a gate signal to the pixel circuits, the gate signal controlling timing of display of the image signal that is displayed on the display panel, a controller that controls the gate driving circuit and the source driving circuit, and a notification part. The controller includes a signal processing circuit. The signal processing circuit includes an accumulator circuit that accumulates display history information regarding the light-emitting devices, and a detection circuit that detects a degree of deterioration of the display panel by the display history information accumulated, and detects a rotation-recommended state of the display panel on the basis of the degree of deterioration. The detection circuit is configured to, in a case where the display panel is divided into a plurality of blocks each including the same number of pixel circuits, detect the degree of deterioration for each of the plurality of blocks, if the number of the plurality of blocks whose degrees of deterioration are greater than or equal to a first threshold value determined in advance is greater than or equal to a predetermined number, detect that the display panel is in the rotation-recommended state, and cause the notification part to notify a result of the detection.

With this configuration, the display panel is rotated before a limit is reached at which it is no longer possible to resolve a decrease in the luminance of light-emitting devices by correcting the luminance. Thus, it is possible, by correcting the light emission luminance of deteriorated light-emitting devices, to cause the light-emitting devices to emit light at proper luminance and display Images. This prolongs the lifetime of the display device.

The detection circuit may further include a maximum value detector that detects, as the degree of deterioration, a maximum value of accumulated values of the display history information regarding the light-emitting devices for each of the plurality of blocks.

With this configuration, the rotation-recommended state can be detected with high accuracy, because a maximum value of the accumulated values of the display history information regarding the light-emitting devices for each of the plurality of blocks is detected as the degree of deterioration.

The detection circuit may further include a determination part that calculates, as the degree of deterioration, an average value of a first degree of deterioration for each of the plurality of blocks and a second degree of deterioration for each of the plurality of blocks that overlap respectively with positions of the plurality of blocks when the display panel is rotated in an in-plane direction, and determines whether the average value calculated is less than or equal to a second threshold value.

With this configuration, in which the average value of the degrees of deterioration before and after rotation of the display panel is calculated, it is possible to predetermine whether a decrease in the luminance of light-emitting devices in a predetermined block can be resolved by rotating the display panel. This increases the efficiency of rotating the display panel.

The signal processing circuit is configured to, in a case where the detection circuit has detected that the display panel is in the rotation-recommended state, and the display panel is rotated, operate the gate driving circuit to change an order in which the gate signal is output to the plurality of pixel circuits arranged in a column direction on the display panel from a first direction to a second direction opposite to the first direction, and operate the source driving circuit to change an order in which the image signal is output to the plurality of pixel circuits arranged in a row direction on the display panel from a third direction orthogonal to the first direction to a fourth direction opposite to the third direction.

The gate driving circuit may be capable of changing an order in which the gate signal is output to the plurality of pixel circuits arranged in a column direction on the display panel into either a first direction or a second direction opposite to the first direction, and the source driving circuit may be capable of changing an order in which the image signal is output to the plurality of pixel circuits arranged in a row direction on the display panel into either a third direction orthogonal to the first direction or a fourth direction opposite to the third direction.

With this configuration, an image can be displayed in a proper orientation on the display panel, because the order of output of gate signals from the gate driving circuit and the order of output of image signals from the source driving circuit are reversed after the display panel is rotated.

The display device may further include a rotation mechanism that rotates the display panel.

Thus, the display panel can easily be rotated when the display panel is detected as being in the rotation-recommended state.

In order to achieve the object described above, a non-transitory computer-readable recording medium according to an aspect of the present invention has recorded thereon a program for use in a computer and for detecting a rotation-recommended state of a display panel in which a plurality of pixel circuits each including a light-emitting device are arranged in rows and columns. The program causes the computer to execute, in a case where the display panel is divided into a plurality of blocks each having the same number of the pixel circuits, detecting a degree of deterioration for each of the plurality of blocks from display history information that is accumulated in an accumulator circuit, and if the number of the plurality of blocks whose degrees of deterioration are greater than or equal to a first threshold value determined in advance is greater than or equal to a predetermined number, detecting that the display panel is in the rotation-recommended state.

With this program, the display panel is rotated before a limit is reached at which it is no longer possible to resolve a decrease in the luminance of light-emitting devices by correcting the luminance. Thus, it is possible, by correcting the light emission luminance of deteriorated light-emitting devices, to cause the light-emitting devices to emit light at proper luminance and display images. This prolongs the lifetime of the display device.

The program may cause the computer to detect, as the degree of deterioration, a maximum value of accumulated values of the display history information regarding the light-emitting devices for each of the plurality of blocks.

With this program, the rotation-recommended state can be detected with high accuracy, because a maximum value of the accumulated values of the display history information regarding the light-emitting devices for each of the plurality of blocks is detected as the degree of deterioration.

The program may cause the computer to calculate, as the degree of deterioration, an average value of a first degree of deterioration for each of the plurality of blocks and a second degree of deterioration for each of the plurality of blocks that overlap respectively with positions of the plurality of blocks when the display panel is rotated in an in-plane direction, and to determine whether the average value calculated is less than or equal to a second threshold value.

With this program, in which the average value of the degrees of deterioration before and after rotation of the display panel is calculated, it is possible to predetermine whether a decrease in the luminance of light-emitting devices in a predetermined block can be resolved by rotating the display panel. This increases the efficiency of rotating the display panel.

The program may cause the computer to, in a case where the computer has detected that the display panel is in the rotation-recommended state, and the display panel is rotated, operate the gate driving circuit to change an order in which a gate signal is output from the gate driving circuit to a plurality of pixel circuits arranged in a column direction on the display panel from a first direction to a second direction opposite to the first direction, and operate the source driving circuit to change an order in which an image signal is output from the source driving circuit to the plurality of pixel circuits arranged in a row direction on the display panel from a third direction orthogonal to the first direction to a fourth direction opposite to the third direction.

With this program, an image can be displayed in a proper orientation on the display panel, because the order of output of gate signals from the gate driving circuit and the order of output of image signals from the source driving circuit are reversed after the display panel is rotated.

Advantageous Effects

With the signal processing circuit, the recording medium, and the display device according to the present disclosure, it is possible to prolong the lifetime of the display device.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DESCRIPTION OF EMBODIMENT

Figure 1:
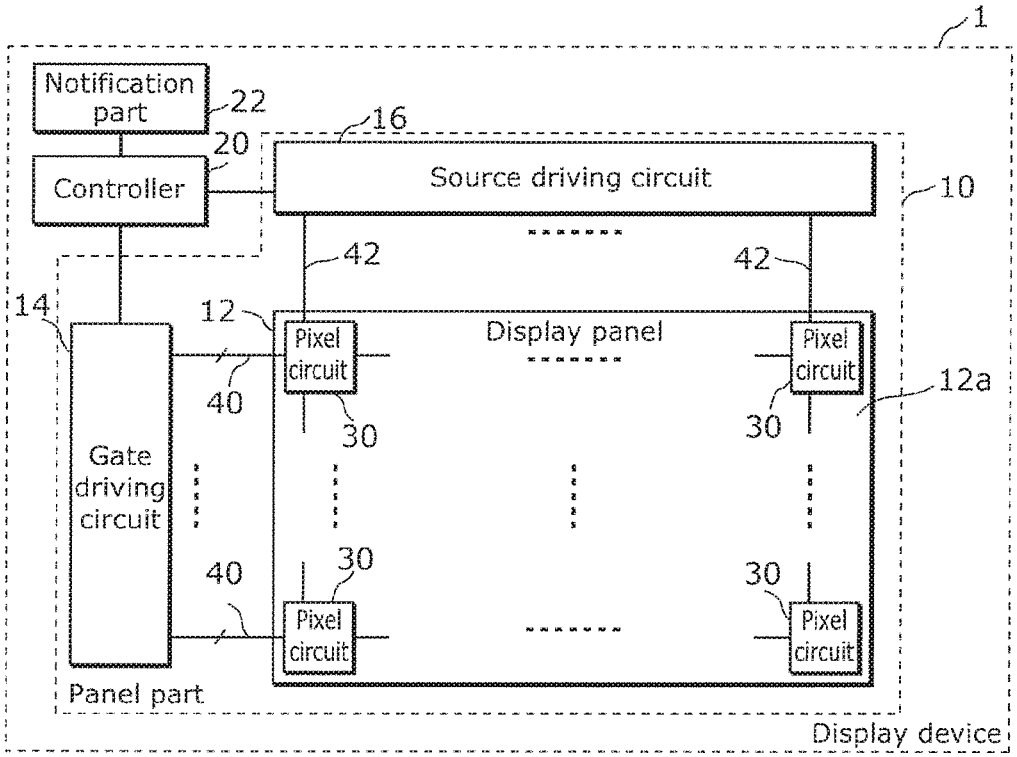
FIG. 1 is a schematic diagram illustrating an exemplary configuration of a display device according to an embodiment.

An embodiment of the present disclosure will now be described hereinafter. Note that the embodiment described below shows a desirable specific example of the present disclosure. Thus, numerical values, shapes, materials, constituent elements, arrangement and positions of constituent elements, connection forms, steps, the order of steps, and so on given in the following embodiment are merely examples and are not intended to limit the present disclosure. Among the constituent elements in the following embodiment, those that are not recited in any one of the independent claims, which represent the broadest concept of the present disclosure, are described as optional constituent elements.

Each drawing is a schematic diagram and does not always strictly follow the actual configuration. In the drawings, constituent elements that are substantially identical are given the same reference signs, and redundant descriptions thereof are omitted or simplified.

Embodiment

An Embodiment will now be described hereinafter with reference to FIGS. 1 to 8B. The present embodiment describes a display device 1 using organic electroluminescent (EL) devices as an example of the display device.

1. Configuration of Display Device

Figure 2:
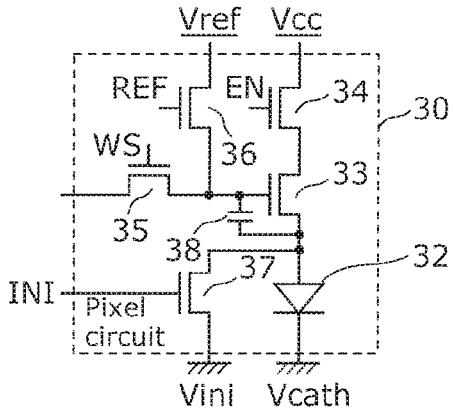
FIG. 2 is a circuit diagram illustrating a configuration of a pixel circuit according to the embodiment.
Figure 3:
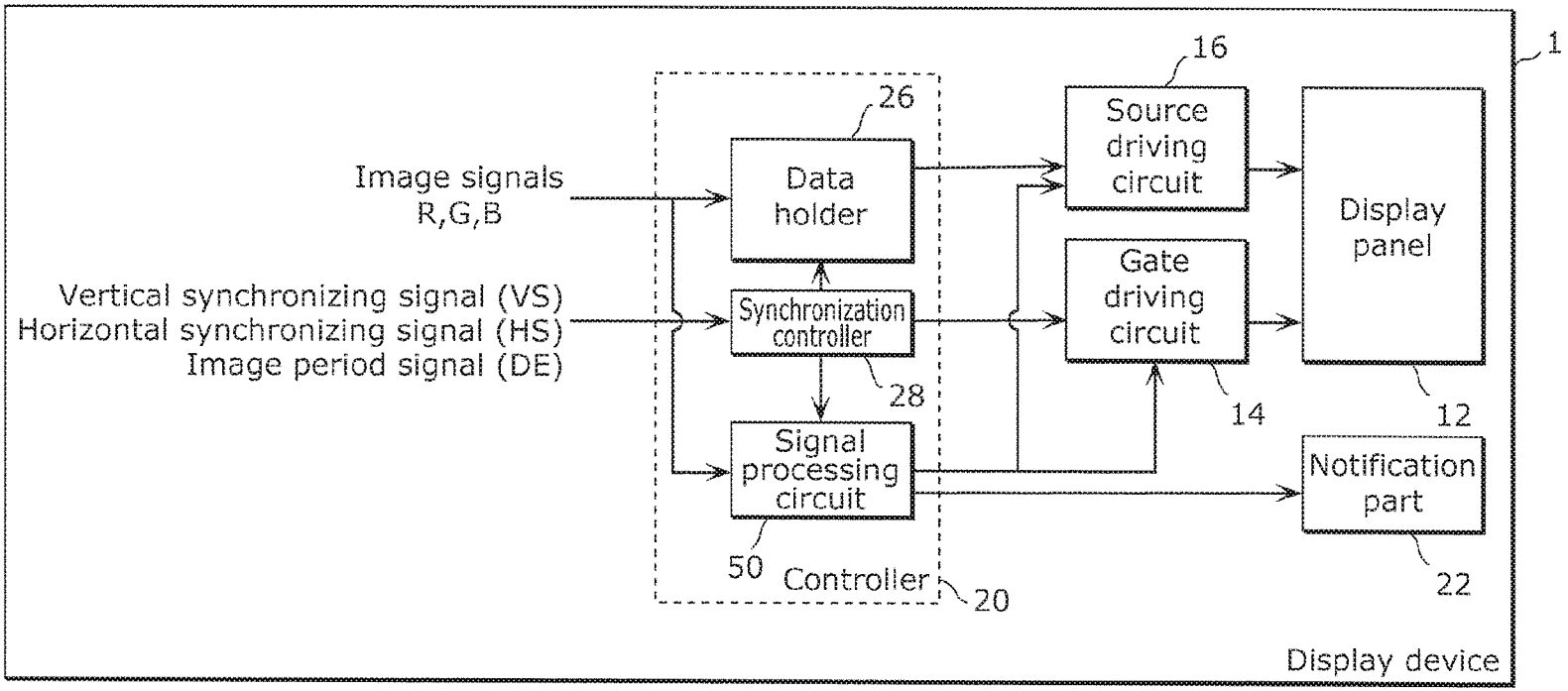
FIG. 3 is a block diagram illustrating a configuration of the display device according to the embodiment.

First, a configuration of the display device 1 will be described. FIG. 1 is a schematic diagram of an exemplary configuration of the display device 1 according to the present embodiment. FIG. 2 is a circuit diagram illustrating a configuration of a pixel circuit 30 according to the present embodiment. FIG. 3 is a block diagram illustrating the configuration of the display device 1 according to the present embodiment.

As illustrated in FIG. 1, the display device 1 is configured by a panel part 10, a controller 20, and a notification part 22. The panel part 10 includes a display panel 12, a gate driving circuit 14, a source driving circuit 16, scanning lines 40, and signal lines 42. The display panel 12, the gate driving circuit 14, the source driving circuit 16, the scanning lines 40, and the signal lines 42 may be implemented on a panel board 12*a*.

The display panel 12 includes the panel board 12*a*, a plurality of pixel circuits 30 arranged in rows and columns on the panel board 12*a*, the scanning lines 40, and the signal lines 42. To be more specific, the display panel 12 includes rows of scanning lines 40, columns of signal lines 42, and the pixel circuits 30, each disposed at an intersection of a scanning line and a signal line and including a light-emitting device 32. The panel board 12*a* may be made of a resin such as glass or acrylic.

The pixel circuits 30 may be formed on the panel board 12*a* by a semiconductor process. The pixel circuits 30 may be arranged in N rows and M columns, where N and M vary depending on the size and resolution of the display screen. For example, in the case where the screen has a resolution called high definition (HD) and pixel circuits 30 corresponding to the three primary colors R, G, and B are adjacent to one another in the rows, N is at least 1080, and M is at least 1920×3. Each pixel circuit 30 includes an organic EL device as a light-emitting device and constitutes a light-emitting pixel of one of the three primary colors R, G, and B.

The pixel circuits 30 each include the light-emitting device 32, a driving transistor 33, a selector transistor 35, switching transistors 34, 36, and 37, and a pixel capacitor 38 as illustrated in FIG. 2. The details of the configuration and operations of the pixel circuit 30 will be described later.

The scanning lines 40 are each routed for each row of pixel circuits 30 arranged in rows and columns. One end of each scanning line 40 is connected to the output of each stage of the gate driving circuit 14.

The signal lines 42 are each routed for each column of pixel circuits 30 arranged in rows and columns. One end of each signal line 42 is connected to the output of each stage of the source driving circuit 16.

The gate driving circuit 14 is a driving circuit that is also referred to as a row driving circuit and scans gate driving signals in rows of pixel circuits 30. The gate driving signals are signals that are input to the gates of the driving transistor 33, the selector transistor 35, and the switching transistors 34, 36, and 37 in each pixel circuit 30 and control the switching on/off of each transistor. The gate driving circuit 14 outputs, for example, a control signal WS, an extinction signal EN, a control signal REF, and a control signal INI as signals for controlling the selector transistor 35 and the switching transistors 34, 36, and 37. The gate driving circuit 14 is disposed on one short side of the display panel 12 as illustrated in FIG. 1.

The gate driving circuit 14 may be configured by shift registers. Upon receiving an image period signal DE from the controller 20, the gate driving circuit 14 outputs gate driving signals in synchronization with a vertical synchronizing signal VS, which is also received from the controller 20, to drive the scanning lines 40. Accordingly, the pixel circuits 30 are selected sequentially one line at a time for each frame, and the light-emitting device 32 of each pixel circuit 30 emits light at a luminance corresponding to an image signal.

The gate driving circuit 14 is also capable of changing the order in which gate signals are output to the plurality of pixel circuits arranged in the column direction on the display panel 12 into either a first direction or a second direction opposite to the first direction. The first direction as used herein may be a horizontal direction from left to right of the display panel 12 illustrated in FIG. 1. In this case, the second direction is a horizontal direction from right to left of the display panel 12 illustrated in FIG. 1.

Note that the gate driving circuit 14 may be disposed on one short side of the display panel 12 as illustrated in FIG. 1, or may be disposed on each of the two opposite short sides of the display panel 12. If the gate driving circuit 14 is disposed on each of the two opposite sides of the display panel 12, it is possible to supply the same gate driving signal at the same time to a plurality of pixel circuits 30 arranged on the display panel 12. This suppresses deterioration of signals due to the wiring capacitance of each scanning line 40, for example when the display panel 12 is a large panel.

The source driving circuit 16 is a driving circuit that is also referred to as a column driving circuit and supplies image signals, which are supplied on a frame-by-frame basis from the controller 20, to each pixel circuit 30. The source driving circuit 16 is disposed on one long side of the display panel 12.

The source driving circuit 16 is also a current-written or voltage-written driving circuit that writes luminance information based on the image signal to each pixel circuit 30 in the form of a current or voltage value. The source driving circuit 16 according to the present embodiment may be a voltage-written driving circuit. The source driving circuit 16 supplies voltages that represent the brightness of the light-emitting device 32 of each pixel circuit 30 to the signal lines 42 on the basis of the image signals input from the controller 20.

The source driving circuit 16 is also capable of changing the order in which image signals are to the plurality of pixel circuits 30 arranged in the row direction on the display panel 12 into either a third direction orthogonal to the first direction or a fourth direction opposite to the third direction. The third direction as used herein may be a vertical direction from top to bottom of the display panel 12 illustrated in FIG. 1. In this case, the fourth direction is a vertical direction from bottom to top of the display panel 12 illustrated in FIG. 1.

The image signals input from the controller 20 to the source driving circuit 16 may be digital serial data (Image signals R, G, and B) for each of the three primary colors R, G, and B. The image signals R, G, and B that are input to the source driving circuit 16 are converted into parallel data on a row-by-row basis within the source driving circuit 16. The parallel data on a row-by-row basis is further converted into analog data on a row-by-row basis within the source driving circuit 16 and output to the signal lines 42. The voltages output to the signal lines 42 are written to the pixel capacitors 38 of the pixel circuits 30 that belong to the row selected in the scanning of the gate driving circuit 14. That is, electric change corresponding to the voltages output to the signal lines 42 is accumulated in the pixel capacitors 38.

The controller 20 is formed on an external system circuit board (not shown) disposed outside the display panel 12. The controller 20 may have the function of a timing controller (TCON) and controls the overall operation of the display device 1. Specifically, the controller 20 instructs the gate driving circuit 14 to perform a scan in accordance with the vertical synchronizing signal VS, a horizontal synchronizing signal HS, and the image period signal DE, which are supplied from external sources. The controller 20 also supplies digital serial data regarding the image signals R, G, and B to the source driving circuit 16 At this time, the controller 20 controls the gate driving circuit 14 and the source driving circuit 16 such that the image signals R, G, and B are displayed at the desired timing and at the desired luminance on the display panel 12. More specifically, the controller 20 controls the light emission luminance of the light-emitting device 32, the timing of light emission, and the duty (on-duty) cycle between the light emission period and the extinction period.

As illustrated in FIG. 3, the controller 20 includes a data holder 26, a synchronization controller 28, and a signal processing circuit 50. Note that the controller 20 may also include a receiver (not shown) that receives signals supplied from an external source and supplies the received signals to the data holder 26, the synchronization controller 28, and the signal processing circuit 50.

The data holder 26 is a buffer that temporarily holds the image signals R, G, and B. The data holder 26 may be a line buffer. The data holder 26 successively holds the image signals R, G, and B for each line received from an external source and outputs the received image signals at a predetermined timing to the source driving circuit 16.

The synchronization controller 28 is a controller that controls the timing of display of the image signals R, G, and B on the display panel 12. The synchronization controller 28 receives the vertical synchronizing signal VS, the horizontal synchronizing signal HS, and the image period signal DE from external sources and outputs the received signals to the gate driving circuit 14 and the source driving circuit 16. Also, the synchronization controller 28 may output a synchronization control signal to the signal processing circuit 50. The signal processing circuit 50 may perform signal processing, which will be described later, at a predetermined timing in accordance with the synchronization control signal.

The signal processing circuit 50 is a circuit that detects the degree of deterioration of the light-emitting devices 32, and if the degree of deterioration has reached a predetermined value, then causes the notification part 22 to notify the user that the display panel 12 is recommended to be rotated. The details of the configuration of the signal processing circuit 50 will be described later.

The controller 20 may further include a timing adjustment part (not shown) that controls the gate driving circuit 14 in accordance with the vertical synchronizing signal VS, the horizontal synchronizing signal HS, and the image period signal DE, which are supplied from external sources, and adjusts the timing of display of the image signals R, G, and B. The signal processing circuit 50 may further include a duty adjustment part (not shown) that adjusts the duty (on-duty) cycle between the light emission period and the extinction period in accordance with the image period signal DE. The signal processing circuit 50 may further include a luminance adjustment part (not shown) that adjusts the luminance of the image signals R, G, and B, which are temporarily held in the data holder 26, and outputs the luminance to the source driving circuit 16.

The notification part 22 may be configured by an LED light-emitting device. The notification part 22 lights on and off in accordance with the signal received from the signal processing circuit 50. In this way, the notification part 22 notifies the user that the display panel 12 is in a state in which the display panel 12 is recommended to be rotated (i.e., in a rotation-recommended state). Note that the notification part 22 is not limited to the LED light-emitting device and may be any other light-emitting device, or may be a device other than the light-emitting devices.

The source driving circuit 16 may be disposed on one long side of the display panel 12 as illustrated in FIG. 1, or may be disposed on each of the two opposite long sides of the display panel 12. In this case, it is possible to output a voltage at the same time to each pixel circuit 30 in the same column, for example when the display panel 12 is a large panel.

The display device 1 may further include a rotation mechanism (not shown) for rotating the display panel 12 in an in-plane direction. The rotation mechanism may be a mechanism capable of turning the display panel 12 from top to bottom and mounting the display panel 12 on a removable foundation, or may be a mechanism for mounting the display panel 12 on a foundation and then rotating the display panel 12 in an in-plane direction, or may be any mechanism as long as it is configured to rotate the display panel 12 in an in-plane direction.

2. Configuration of Pixel Circuit

The pixel circuits 30 each include the light-emitting device 32, the driving transistor 33, the selector transistor 35, the switching transistors 34, 36, and 37, and the pixel capacitor 38 as illustrated in FIG. 2.

The light-emitting device 32 may be a diode-type organic EL device that includes an anode and a cathode. Note that the light-emitting device 32 is not limited to the organic EL device and may be any other light-emitting device. The light-emitting device 32 may be any device that is generally current-driven to emit light.

The light-emitting device 32 may include a plurality of first electrode layers made of a transparent conducting film, an organic layer formed by depositing a hole transport layer, a light-emitting layer, an electron transport layer, and an electron injection layer in the specified order on the first electrode layers, and a second electrode layer made of a metal film and formed on the organic layer. Note that the light-emitting device 32 is schematically illustrated in symbolic form in FIG. 2. When a direct voltage is applied between the first electrode layers and the second electrode layer of the light-emitting device 32, electrons and holes recombine with each other in the light-emitting layer. As a result, the light-emitting device 32 emits light at a luminance corresponding to the signal potential of the image signal with a drain-source current of the driving transistor 33 supplied from the driving transistor 33.

The driving transistor 33 is an active device that drives and causes the light-emitting device 32 to emit light. When turned on, the driving transistor 33 supplies the drain-source current corresponding to the gate-source voltage to the light-emitting device 32.

The switching transistor 34 is turned on or off in accordance with the extinction signal EN supplied from the scanning line 40. When turned on, the switching transistor 34 connects the driving transistor 33 to a power source Vcc to supply the drain-source current of the driving transistor 33 to the light-emitting device 32.

The selector transistor 35 is turned on in accordance with the control signal WS supplied from the scanning line 40 and accumulates electric charge that corresponds to the signal potential of the image signal supplied from the signal lines 42, in the pixel capacitor 38.

The switching transistor 36 is turned on in accordance with the control signal REF supplied from the scanning line 40 and sets the source of the driving transistor 33 to a reference voltage Vref.

The switching transistor 37 is turned on in accordance with the control signal INI supplied from the scanning line 40 and sets the source of the driving transistor 33 to a reference voltage Vini.

The pixel capacitor 38 applies a voltage to the gate of the driving transistor 33 in accordance with the signal potential produced by the accumulated electric charge.

Note that the driving transistor 33, the selector transistor 35, and the switching transistors 36 and 37 may be N-channel type polysilicon thin film transistors (TFTs). The switching transistor 34 may be a P-channel type polysilicon TFT. The conductivity type of each transistor is not limited to the example described above, and N- and P-channel type TFTs may be appropriately mixed. Each transistor is not limited to a polysilicon TFT, and may be a TFT of another material such as an amorphous silicon TFT.

The pixel circuits 30 receive the supply of the control signals WS, REF, and INI and the extinction signal EN at predetermined timings from the controller 20, so that each transistor is turned on or off and a frame period consisting of an initialization period, a Vth compensation period, a light emission period, and an extinction period is repeated. This causes the light-emitting devices 32 arranged in rows and columns to emit light in order in accordance with the signal potentials of the image signals during each frame period, thereby displaying an image on the display panel 12.

3. Configuration of Signal Processing Circuit

Figure 4A:
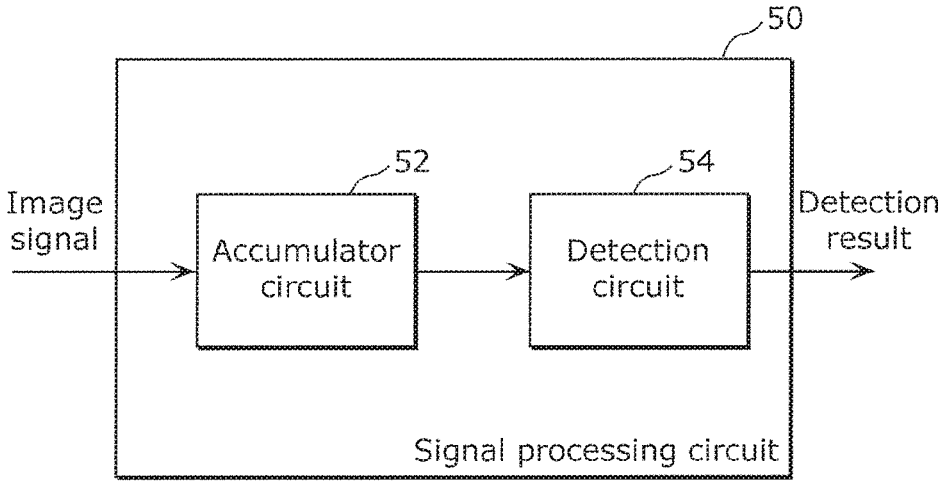
FIG. 4A is a block diagram illustrating a configuration of a signal processing circuit included in the display device according to the embodiment.
Figure 4B:
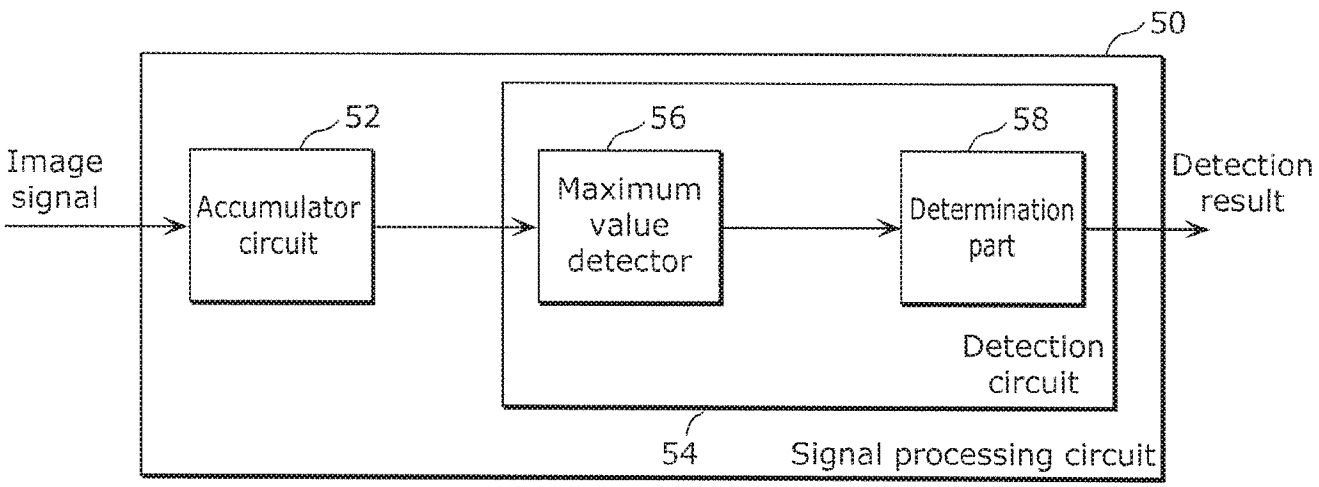
FIG. 4B is a block diagram illustrating the configuration of the signal processing circuit included in the display device according to the embodiment.

Next, a configuration of the signal processing circuit 50 will be described. FIGS. 4A and 4B are block diagrams illustrating the configuration of the signal processing circuit 50 in the display device 1 according to the present embodiment.

The signal processing circuit 50 is a circuit that detects the degrees of deterioration of the light-emitting devices 32 and, if the degrees of deterioration have reached a predetermined value, recommends the user to rotate the display panel 12. As illustrated in FIG. 4A, the signal processing circuit 50 includes an accumulator circuit 52 and a detection circuit 54.

The accumulator circuit 52 is a circuit that holds display history information obtained by accumulating the light emission luminance of the light-emitting devices 32. The accumulator circuit 52 may be a memory circuit. The display history information may be information obtained by accumulating the light emission luminance for each pixel circuit 30, or may be information obtained by dividing the pixel circuits 30 arranged in rows and columns in the display panel 12 into a plurality of blocks and accumulating the light emission luminance of the pixel circuits 30 for each divided block. The display history information is output to the detection circuit 54. The details of the divided blocks of the display panel 12 will be described later.

The detection circuit 54 is a circuit that receives the display history information output from the accumulator circuit 52, detects the degree of deterioration from the display history information regarding the light-emitting devices 32, and detects the rotation-recommended state of the display panel 12. The rotation-recommended state as used herein refers to a state in which it is desirable for the display panel 12 to be rotated in an in-plane direction to change the arrangement position of each pixel circuit 30 in order to suppress the occurrence of so-called burn-in of an image on the display panel 12, which may be caused by deterioration of the light-emitting devices 32 over time.

The detection circuit 54 includes a maximum value detector 56 and a determination part 58 as illustrated in FIG. 4B.

The maximum value detector 56 detects a maximum value of the accumulated values of the light emission luminance of the pixel circuits 30 for each block as the degree of deterioration by the accumulated value of the light emission luminance of the light-emitting device 32 of each pixel circuit 30 stored in the accumulator circuit 52. The degrees of deterioration may be indicated by numeric values that classify the accumulated values of the light emission luminance into 60 levels from 0 to 59. Then, the degrees of deterioration and the numbers of blocks corresponding thereto are stored as a histogram as will be described later. Note that the maximum value detector 56 does not necessarily have to hold the degree of deterioration for each block and the number of blocks corresponding thereto as a histogram, and may hold them by other methods. For example, the maximum value detector 56 may hold a table that associates the degree of deterioration for each block with the number of blocks corresponding thereto.

The determination part 58 uses the histogram of the degrees of deterioration detected by the maximum value detector 56 to determine whether the display panel 12 is in the rotation-recommended state. To be specific, if the number of blocks (block number) P1 whose degrees of deterioration are greater than or equal to a threshold value Sth1 is greater than or equal to a predetermined number according to the histogram held by the maximum value detector 56, the determination part 58 determines that the display panel 12 is in the rotation-recommended state. In the present embodiment, Sth1 is a first threshold value. The predetermined number may be set to 20% of the total number of blocks included in the display panel 12.

In addition to determining whether the display panel 12 is in the rotation-recommended state by the number of blocks whose degrees of deterioration are greater than or equal to the threshold value Sth1 as described above, the determination part 58 also calculates an average value of the degrees of deterioration for the case where the display panel 12 is not rotated and for the case where it is assumed that the display panel 12 is rotated. To be more specific, the determination part 58 calculates an average value of a first degree of deterioration and a second degree of deterioration as the degree of deterioration for one block and determines whether the calculated average value is less than or equal to a second threshold value, the first degree of deterioration being the degree of deterioration for the block that is located at a position prior to the rotation of the display panel 12, and the second degree of deterioration being the degree of deterioration for a block that overlaps with the position of the above block when the display panel is rotated in an in-plane direction. The same processing is performed for each of the plurality of blocks of the display panel 12.

The determination part 58 also holds the calculated average value of the degrees of deterioration and the number of blocks corresponding thereto as a histogram, as will be described later. Then, if the average values of the degrees of deterioration for all the blocks are less than or equal to a threshold value Sth2 that is a predetermined number of times as large as the threshold value Sth1, the determination part 58 determines that the display panel 12 is in the rotation-recommended state. In the present embodiment, Sth2 is the second threshold value. The predetermined number of times as large as the threshold value Sth1 may be 0.75.

Note that the determination part 58 does not necessarily have to hold the average value of the degrees of deterioration for each block and the number of blocks corresponding thereto as a histogram, and may hold them by other methods. For example, the determination part 58 may hold a table that associates the average value of the degrees of deterioration for each block with the number of blocks corresponding thereto.

If the average value of the degrees of deterioration is less than or equal to the threshold value Sth2 that is the predetermined number of times as large as the threshold value Sth1, it is possible, by rotating the display panel 12, to prolong the lifetime of the display device 1 during use. In the case where the average value of the degrees of deterioration exceeds the threshold value Sth2 that is the predetermined number of times as large as the threshold value Sth1, the deterioration of the light-emitting devices 32 over time will appear on the rotated display panel 12 even if the display panel 12 is rotated. In this case, it is difficult to prolong the lifetime of the display device 1 during use.

Note that the value calculated by the determination part 58 is not limited to the average value of the degrees of deterioration for the case where the display panel 12 is not rotated and for the case where it is assumed that the display panel 12 is rotated, and may be a total value thereof. In this case, the predetermined number of times as large as the threshold value Sth1 may be 1.5.

The details of the method of detecting the rotation-recommended state of the display panel 12 will be described later.

Depending on the degree of deterioration detected by the detection circuit 54, the signal processing circuit 50 controls whether to output gate signals in order in the first direction or in the second direction opposite to the first direction from the gate driving circuit 14. The signal processing circuit 50 also controls whether to output image signals in order in the third direction orthogonal to the first direction or in the fourth direction opposite to the third direction from the source driving circuit 16.

Also, the signal processing circuit 50 supplies a signal for turning the LED light-emitting device on to the notification part 22 configured by the LED light-emitting device, on the basis of the display history information. As a result, the notification part 22 emits light and notifies the user that it is time to rotate the display panel 12.

Note that the signal processing circuit 50 may be configured to include other circuits, in addition to the accumulator circuit 52 and the detection circuit 54, as described above. For example, the signal processing circuit 50 may include a storage (not shown) that is a computer-readable storage medium having stored therein a program for detecting the rotation-recommended state of the display panel and performing signal processing for determining whether to turn the display panel 12 upside down.

The signal processing circuit 50 does not necessarily have to cause the maximum value detector 56 to detect a maximum value of the accumulated values of the light emission luminance of the pixel circuits 30 for each block as the degree of deterioration as described above, and may be configured to detect, as the degree of deterioration, an average value of the accumulated values of the light emission luminance of the pixel circuits 30 for each block.

4. Procedure for Signal Processing of Signal Processing Circuit

Figure 5:
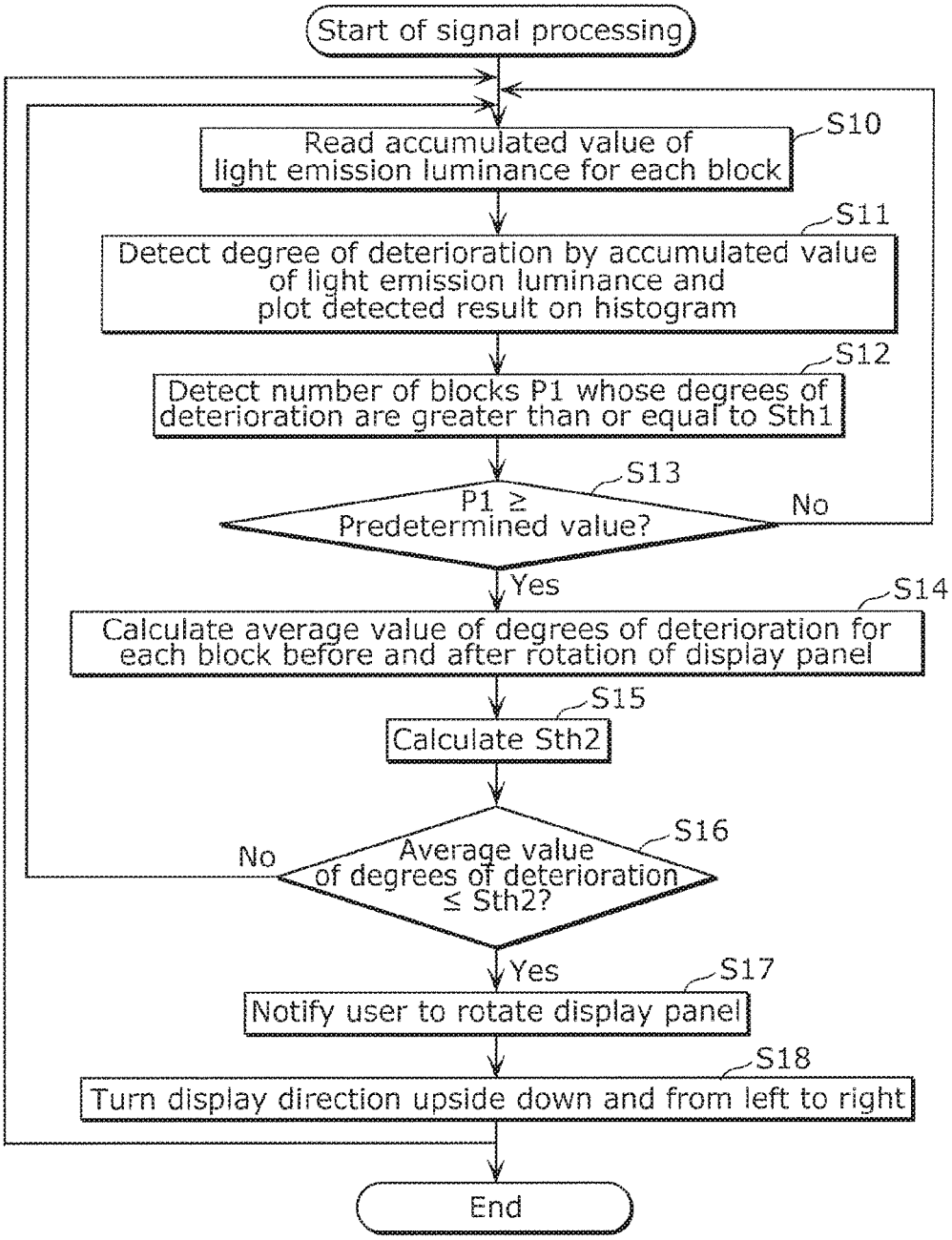
FIG. 5 is a flowchart illustrating a procedure of signal processing performed by the signal processing circuit according to the embodiment.

Description is now given on the procedure for signal processing performed by the signal processing circuit 50 that determines the rotation-recommended state of the display panel 12 and rotates and causes the display panel 12 to display an image normally. FIG. 5 is a flowchart of the procedure for the signal processing of the signal processing circuit 50 according to the present embodiment. Note that the following procedure may be programmed and stored as a program in one of the signal processing circuit 50, the controller 20, and the display device 1.

As illustrated in FIG. 5, the signal processing circuit 50 first reads out the accumulated values of the light emission luminance of the plurality of pixel circuits 30 from the accumulator circuit 52 (step S10) and outputs the accumulated values to the detection circuit 54. The maximum value detector 56 of the detection circuit 54 detects, as the degree of deterioration, a maximum value of the accumulated values of the light emission luminance of the pixel circuits 30 for each divided block of the display panel 12.

Figure 6A:
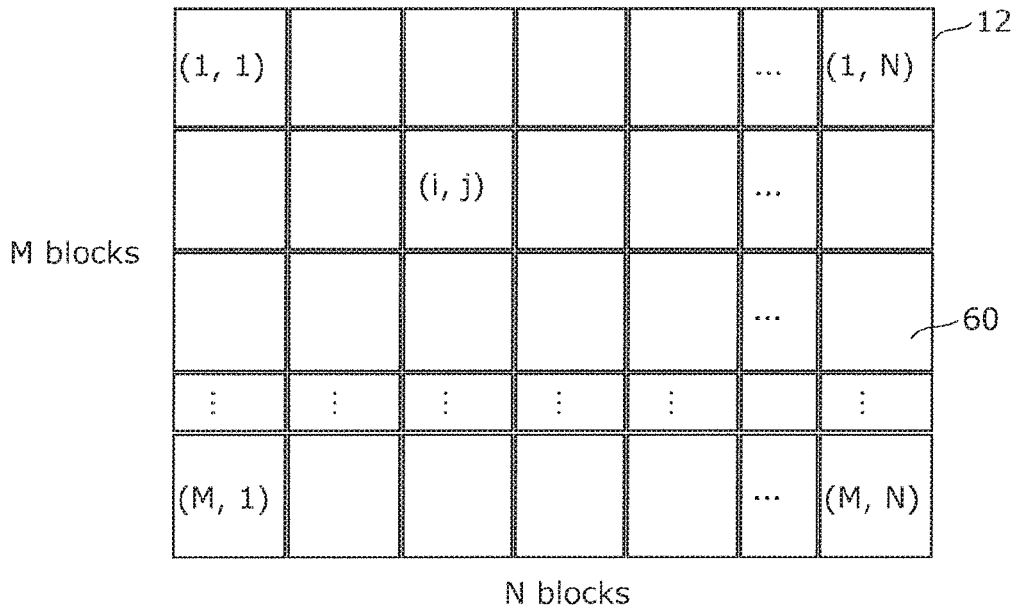
FIG. 6A is a schematic diagram of blocks into which a panel part is divided in the display device according to the embodiment.
Figure 6B:
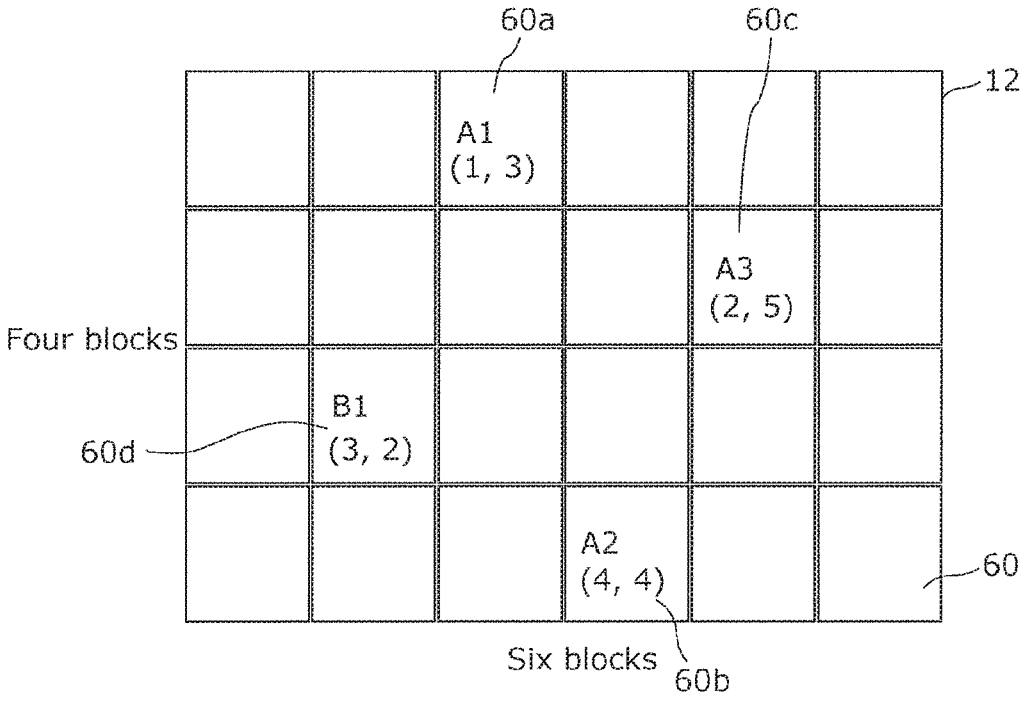
FIG. 6B is a schematic diagram illustrating a specific example of the blocks of the panel part in the display device according to the embodiment.

FIG. 6A is a schematic diagram of the display panel 12 divided into blocks in the display device 1 according to the present embodiment. FIG. 6B is a schematic diagram showing a specific example of the display panel 12 divided into blocks in the display device 1 according to the present embodiment.

The pixel circuits 30 arranged in rows and columns in the display panel 12 are divided into a plurality of blocks 60 as illustrated in FIG. 6A. The display panel 12 illustrated in FIG. 6A has M blocks 60 arranged in the column direction and N blocks 60 arranged in the row direction. In the display panel 12 in FIG. 6A, the position of each block 60 is indicated by coordinates (i, j). For example, the block 60 disposed at the upper leftmost position in FIG. 6A has coordinates (1, 1), and the block 60 disposed at the lower rightmost position has coordinates (M, N).

FIG. 6B illustrates the blocks 60 of the display panel 12, where M=4 and N=6. In FIG. 6B, a block 60*a* has coordinates (1, 3), a block 60*b* has coordinates (4, 4), a block 60*c* has coordinates (2, 5), and a block 60*d* has coordinates (3, 2). The degrees of deterioration of the blocks 60*a*, 60*b*, 60*c*, and 60*d* may respectively be A1, A2, A3, and B1. Here, A1, A2, and A3 are values greater than or equal to the threshold value Sth1, and B1 is a value smaller than the threshold value Sth1.

Figure 7A:
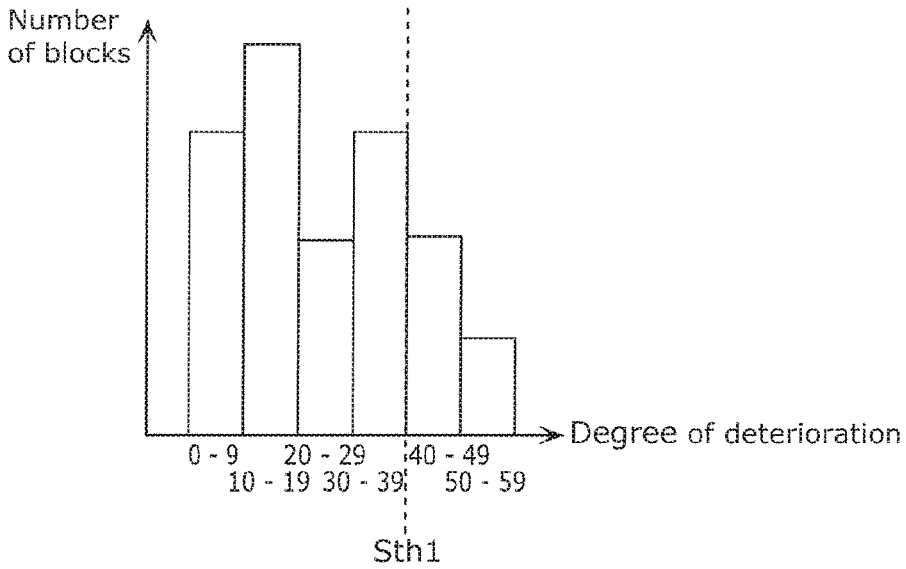
FIG. 7A is a histogram illustrating the degrees of deterioration of the display device according to the embodiment.

Next, the signal processing circuit 50 plots and stores the degrees of deterioration and the numbers of blocks corresponding thereto as a histogram (step S11). FIG. 7A illustrates a histogram that indicates the degree of deterioration of the display device 1 according to the present embodiment.

In the histogram illustrated in FIG. 7A, the horizontal axis indicates the degree of deterioration and the vertical axis indicates the number of blocks. The value of the degree of deterioration increases from left to right. The value of the number of blocks increases from bottom to top. For example, the histogram shows the numbers of blocks that correspond respectively to the degrees of deterioration from level 0 to level 9, from level 10 to level 19, from level 20 to level 29, from level 30 to level 39, from level 40 to level 49, and from level 50 to level 59 in order from left.

Here, the determination part 58 of the signal processing circuit 50 detects the number of blocks P1 whose degrees of deterioration are greater than or equal to the threshold value Sth1 (step S12). The determination part 58 then determines whether the number of blocks P1 is greater than or equal to a predetermined number that has been determined in advance (step S13). If the number of blocks P1 whose degrees of deterioration are greater than or equal to the threshold value Sth1 is less than the predetermined number determined in advance (NO in step S13), the deterioration of the light-emitting devices 32 has not progressed so far and therefore there is no need to rotate the display panel 12. Thus, the signal processing circuit 50 again reads out the accumulated values of the light emission luminance for each block 60 from the accumulator circuit and detects the degree of deterioration (step S10).

If the number of blocks P1 whose degrees of deterioration are greater than or equal to the threshold value Sth1 is greater than or equal to the predetermined value (YES in step S13), the deterioration of the light-emitting devices 32 of the display device 1 has progressed so far and the display panel 12 is in the rotation-recommended state. Accordingly, the determination part 58 calculates the average value of the degrees of deterioration at the position of each block for the case where the display panel 12 is not rotated (before rotation) and for the case where it is assumed that the display panel 12 is rotated (after rotation) in order to determine whether it is effective to rotate the display panel 12 (step S14). The determination part 58 then plots and stores the calculated average values of the degrees of deterioration and the numbers of blocks corresponding thereto as a histogram.

In the display panel 12 illustrated in FIG. 6A, a block 60 that is disposed at a coordinate position (i, j) before rotation overlaps with a coordinate position (M−i+1, N−j+1) after rotation. Assuming that the degree of deterioration at the coordinates (i, j) is S(i, j) and the degree of deterioration at the coordinates (M−i+1, N−j+1) after rotation is S(M−i+1, N−j+1), the average value of the degrees of deterioration of the block 60 disposed at the coordinate position (i, j) and the block 60 disposed at the coordinate position (M−i+1, N−j+1) is {S(i, j)+S(M−i+1, N−j+1)}/2.

In the display panel 12 illustrated in FIG. 6B, for example, the position of the block 60*b* after rotation overlaps with the position of the block 60*a* before rotation. Thus, the average value of the degrees of deterioration at the position of the block 60*a* before rotation is (A1+A2)/2. The average value of the degrees of deterioration at the position of the block 60*b* before rotation is also (A1+A2)/2. Note that (A1+A2)/2 may become a large value because A1 and A2 are large values greater than or equal to the threshold value Sth1.

Similarly, the position of the block 60*d* after rotation overlaps with the position of the block 60*c* before rotation. Thus, the average value of the degrees of deterioration at the position of the block 60*c* before rotation is (A3+B1)/2. The average value of the degrees of deterioration at the position of the block 60*d* before rotation is also (A3+B1)/2. Note that the value (A3+B1)/2 is not as large as the value (A1+A2)/2 because A3 is greater than or equal to the threshold value Sth1, but B1 is smaller than the threshold value.

Figure 7B:
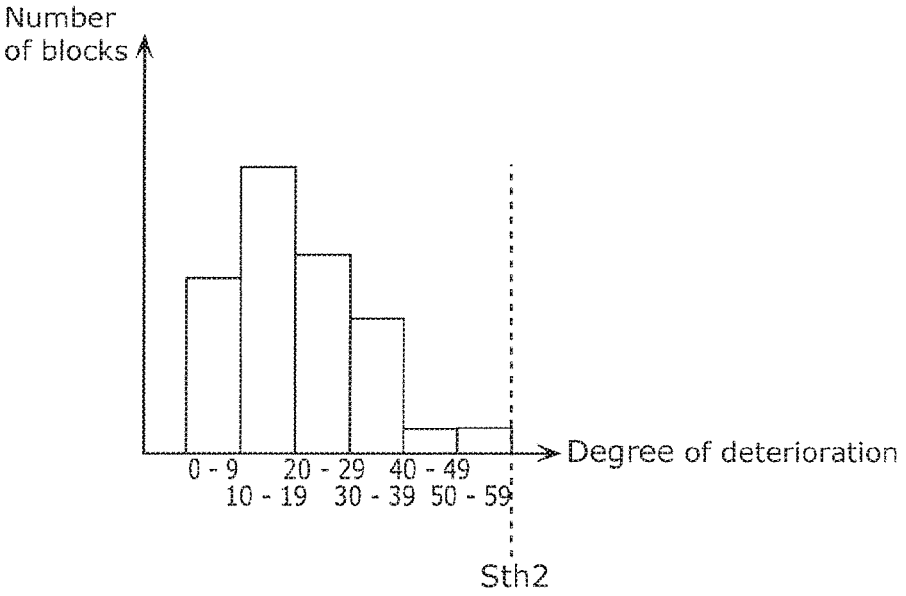
FIG. 7B is a histogram illustrating an average value of the degrees of deterioration before and after rotation of the display panel in the display device according to the embodiment.

FIG. 7B illustrates a histogram that indicates the average values of the degrees of deterioration before and after rotation of the display panel 12 in the display device 1 according to the present embodiment. In the histogram illustrated in FIG. 7B, the horizontal axis indicates the degree of deterioration (average value), and the vertical axis indicates the number of blocks. The value of the degree of deterioration increases from left to right. The value of the number of blocks increases from bottom to top. For example, the histogram shows the numbers of blocks that correspond respectively to the degrees of deterioration from level 0 to level 9, from level 10 to level 19, from level 20 to level 29, from level 30 to level 39, from level 40 to level 49, and from level 50 to level 59 in order from left.

The determination part 58 calculates the threshold value Sth2 that is a predetermined number of times as large as the threshold value Sth1 (step S15). The predetermined number of times as large as the threshold value Sth1 may be 0.75. That is, the threshold value Sth2 is expressed by Sth2=Sth1×0.75. In the display panel 12 illustrated in FIG. 6A, the condition for determining the degree of deterioration can be expressed by {S(i, j)+S(M−i+1, N−j+1)}/2=0.75×Sth1.

The determination part 58 determines whether the average values of the degrees of deterioration for all the blocks illustrated in FIG. 7B are less than or equal to the threshold value Sth2 (step S16).

If the average value of the degrees of deterioration exceeds the threshold value Sth2 (NO in step S16), the deterioration of the light-emitting devices 32 over time will appear on the rotated display panel 12 even if the display panel 12 is rotated. That is, it is not possible to suppress the appearance of the deterioration of the light-emitting devices 32 over time on the display screen even if the display panel 12 is rotated. Thus, the signal processing circuit 50 again reads out the accumulated values of the light emission luminance for each block 60 from the accumulator circuit and detects the degree of deterioration (step S10).

If the average value of the degrees of deterioration is less than or equal to the threshold value Sth2 (Yes in step S16), the appearance of deterioration of the light-emitting devices 32 over time on the display screen can be suppressed by rotating the display panel 12. Thus, the determination part 58 determines that the display panel 12 is in the rotation-recommended state. The signal processing circuit 50 then causes the notification part 22 to notify the user that the display panel 12 is in the rotation-recommended state (step S17). This enables the user to recognize that the display panel 12 is in the rotation-recommended state and to rotate the display panel 12, for example 180 degrees, in an in-plane direction.

Figure 8:
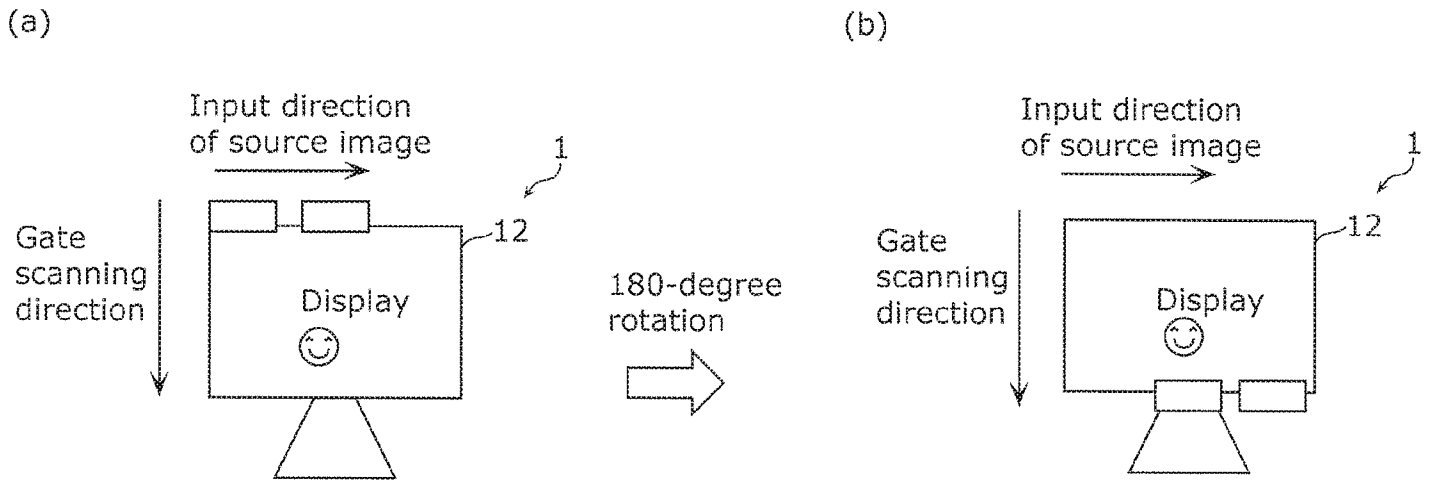
FIG. 8 is a schematic diagram illustrating the external appearance of the display device according to the embodiment, (a) of FIG. 8 illustrating the external appearance before rotation, and (b) of FIG. 8 illustrating the external appearance after rotation.

FIG. 8 is a schematic diagram Illustrating the external appearance of the display device 1 according to the present embodiment, (a) of FIG. 8 illustrating the external appearance before rotation of the display panel 12, and (b) of FIG. 8 illustrating the external appearance after rotation of the display panel 12. When the display panel 12 is rotated 180 degrees in an in-plane direction, the signal processing circuit 50 sets the scanning direction to the reverse direction, i.e., turns the scanning direction 180 degrees (step S18).

That is, the signal processing circuit 50 controls the gate driving circuit 14 such that the gate signals, which have been output in order in the first direction on the display panel 12 before rotation, are output in order in the second direction opposite to the first direction. Similarly, the signal processing circuit 50 controls the source driving circuit 16 such that the image signals, which have been output in order in the third direction on the display panel 12 before rotation, are output in order in the fourth direction opposite to the third direction. Accordingly, the image signals are displayed in the proper orientation. This ends the signal processing of the signal processing circuit 50. Note that the signal processing circuit 50 may repeat the signal processing after the display panel 12 is rotated 180 degrees in an in-plane direction.

Note that the scanning direction may be set after the rotation of the display panel 12 by the user pressing a button for transmitting information indicating the completion of the rotation of the display panel 12 to the signal processing circuit 50, or may be set automatically when a tilt detection sensor such as a gyroscopic sensor provided in the display panel 12 has detected the rotation of the display panel 12.

Note that the value calculated by the determination part 58 is not limited to the average value of the degrees of deterioration for the case where the display panel 12 is not rotated and for the case where it is assumed that the display panel 12 is rotated, and may be a total value thereof. In this case, the predetermined number of times as large as the threshold value Sth1 may be 1.5. In the example of the display panel 12 illustrated in FIG. 6B, the degree of deterioration of the blocks 60*a* and 60*b* is regarded as A1+A2, and the degree of deterioration of the blocks 60*c* and 60*d* is regarded as A3+B1.

5. Advantageous Effects

As described thus far, according to the controller 20 and the display device 1 in the present embodiment, the display panel is rotated before a limit is reached at which it is no longer possible to resolve a decrease in the luminance of the light-emitting devices by correcting the luminance. Thus, it is possible, by correcting the light emission luminance of deteriorated light-emitting devices, to cause the light-emitting devices to emit light at proper luminance and display images. This prolongs the lifetime of the display device.

Also, it is possible, by calculating the average value of the degrees of deterioration before and after rotation of the display panel, to predetermine whether a decrease in the luminance of light-emitting devices in a predetermined block can be resolved by rotating the display panel. This increase the efficiency of rotating the display panel.

Other Embodiments

The present disclosure is not limited to the configuration illustrated in the above-described embodiment, and appropriate modifications may be made.

For example, while the display panel is rotated in the above-described embodiment, the configuration may be such that only the display panel in the display device is rotated, or that the display panel and the controller are formed integrally and rotated together.

The display panel does not necessarily have to be divided into the aforementioned number of blocks. The number of blocks in the display panel may be 4 by 6 as described above, or may be another number. For example, the number of blocks may be 8 by 8.

The maximum value detector does not necessarily have to hold the degree of deterioration for each block and the number of blocks corresponding thereto as a histogram, and may hold them by other methods. For example, the maximum value detector may hold a table that associates the degree of deterioration for each block with the number of blocks corresponding thereto.

The determination part does not necessarily have to hold the degree of deterioration for each block and the number of blocks corresponding thereto as a histogram, and may hold them by other methods. For example, the determination part may hold a table that associates the degree of deterioration for each block with the number of blocks corresponding thereto.

The value calculated by the determination part is not limited to the average value of the degrees of deterioration for the case where the display panel is not rotated and for the case where it is assumed that the display panel is rotated, and may be a total value thereof.

As described above, the signal processing circuit may detect the maximum value of the accumulated values of the light emission luminance of the pixel circuits for each block as the degree of deterioration, or may detect the average value of the accumulated values of the light emission luminance of the pixel circuits for each block as the degree of deterioration. The signal processing circuit may also use methods other than this to detect the degree of deterioration.

The light-emitting devices are not limited to organic EL devices, and may be other light-emitting devices. The light-emitting devices may be any of the devices that are generally current-driven to emit light.

The display device may include a rotation mechanism for rotating the display panel in an in-plane direction. The rotation mechanism may be a mechanism capable of turning the display panel from top to bottom and mounting the display panel on a removable foundation, or may be any mechanism as long as it is configured to rotate the display panel in an in-plane direction.

The angle of rotation of the display panel is not limited to 180 degrees as described above, and may be other angles. For example, if the display panel has a square shape, a configuration for rotating the display panel 90 degrees may be employed.

In the above-described embodiment, the gate driving circuit may be disposed on one short side of the display panel, or may be disposed on each of the two opposite short sides of the display panel. Similarly, the source driving circuit may be disposed on one long side of the display panel, or may be disposed on each of the two opposite long sides of the display panel.

The configuration of the pixel circuits in the display device is not limited to the configuration illustrated in the above-described embodiment, and modifications may be made thereto. For example, the arrangement of the switching transistors may be appropriately changed as long as the display device is configured to include the driving transistor, the selector transistor, and the pixel capacitor. The plurality of transistors provided in the pixel circuits may be polysilicon TFTs, or may be other transistors such as amorphous silicon TFTs. The conductivity types of the transistors may be an N-channel type, a P-channel type, or a combination thereof.

The present disclosure also includes, without departing from the gist of the present disclosure, other embodiments such as those obtained by making various modifications, which are conceivable by a person skilled in the art, to the above-described embodiment, and those obtained by arbitrarily combining any of the constituent elements and functions in the above-described embodiment within a scope that does not depart from the gist of the present disclosure. For example, the present disclosure also includes flat TV systems, game machines with panels, and monitoring systems for personal computers as examples of the display device that includes the controller, the detection circuit, or the signal processing circuit according to the present disclosure.

Although only an exemplary embodiment of the present disclosure has been described in detail above, those skilled in the art will readily appreciate that many modifications are possible in the exemplary embodiment without materially departing from the novel teachings and advantages of the present disclosure. Accordingly, all such modifications are intended to be included within the scope of the present disclosure.

INDUSTRIAL APPLICABILITY

The present disclosure is useful in the technical field of, for example, displays for use in TV systems, game machines, and personal computers.

The invention claimed is:

1. A signal processing circuit for a display panel in which a plurality of pixel circuits each including a light-emitting device are arranged in rows and columns, the signal processing circuit comprising:

an accumulator circuit that accumulates display history information regarding the light-emitting devices; and a detection circuit that detects a degree of deterioration of the display panel from the display history information accumulated, and detects a rotation-recommended state of the display panel on the basis of the degree of deterioration, the detection circuit being configured to:

in a case where the display panel is divided into a plurality of blocks each having the same number of pixel circuits, detect the degree of deterioration for each of the plurality of blocks; and if the number of the plurality of blocks whose degrees of deterioration are greater than or equal to a first threshold value determined in advance is greater than or equal to a predetermined number, detect that the display panel is in the rotation-recommended state.

2. The signal processing circuit according to claim 1, wherein the detection circuit includes a maximum value detector that detects, as the degree of deterioration, a maximum value of accumulated values of the display history information regarding the light-emitting devices for each of the plurality of blocks.

3. The signal processing circuit according to claim 1, wherein the detection circuit includes a determination part that calculates, as the degree of deterioration, an average value of a first degree of deterioration for each of the plurality of blocks and a second degree of deterioration for each of the plurality of blocks that overlap respectively with positions of the plurality of blocks when the display panel is rotated in an in-plane direction, and determines whether the average value calculated is less than or equal to a second threshold value.

4. The signal processing circuit according to claim 1, wherein in a case where the detection circuit has detected that the display panel is in the rotation-recommended state, and the display panel is rotated, the detection circuit operates:

a gate driving circuit that outputs a gate signal is operated to change an order in which the gate signal is output to the plurality of pixel circuits arranged in a column direction on the display panel from a first direction to a second direction opposite to the first direction, and a source driving circuit that outputs an image signal is operated to change an order in which the image signal is output to the plurality of pixel circuits arranged in a row direction on the display panel from a third direction orthogonal to the first direction to a fourth direction opposite to the third direction.

5. A display device comprising:

a display panel in which a plurality of pixel circuits each including a light-emitting device are arranged in rows and columns;

a source driving circuit that supplies an image signal that is displayed on the display panel to the pixel circuits;

a gate driving circuit that supplies a gate signal to the pixel circuits, the gate signal controlling timing of display of the image signal that is displayed on the display panel;

a controller that controls the gate driving circuit and the source driving circuit; and a notification part, wherein the controller includes a signal processing circuit, the signal processing circuit including:

an accumulator circuit that accumulates display history information regarding the light-emitting devices; and a detection circuit that detects a degree of deterioration of the display panel by the display history information accumulated, and detects a rotation-recommended state of the display panel on the basis of the degree of deterioration, and the detection circuit being configured to:

in a case where the display panel is divided into a plurality of blocks each including the same number of pixel circuits, detect the degree of deterioration for each of the plurality of blocks;

if the number of the plurality of blocks whose degrees of deterioration are greater than or equal to a first threshold value determined in advance is greater than or equal to a predetermined number, detect that the display panel is in the rotation-recommended state; and cause the notification part to notify a result of the detection.

6. The display device according to claim 5, wherein the detection circuit includes a maximum value detector that detects, as the degree of deterioration, a maximum value of accumulated values of the display history information regarding the light-emitting devices for each of the plurality of blocks.

7. The display device according to claim 5, wherein the detection circuit includes a determination part that calculates, as the degree of deterioration, an average value of a first degree of deterioration for each of the plurality of blocks and a second degree of deterioration for each of the plurality of blocks that overlap respectively with positions of the plurality of blocks when the display panel is rotated in an in-plane direction, and determines whether the average value calculated is less than or equal to a second threshold value.

8. The display device according to claim 5, wherein the signal processing circuit is configured to:

in a case where the detection circuit has detected that the display panel is in the rotation-recommended state, and the display panel is rotated, operate the gate driving circuit to change an order in which the gate signal is output to the plurality of pixel circuits arranged in a column direction on the display panel from a first direction to a second direction opposite to the first direction; and operate the source driving circuit to change an order in which the image signal is output to the plurality of pixel circuits arranged in a row direction on the display panel from a third direction orthogonal to the first direction to a fourth direction opposite to the third direction.

9. The display device according to claim 5, wherein the gate driving circuit is capable of changing an order in which the gate signal is output to the plurality of pixel circuits arranged in a column direction on the display panel into either a first direction or a second direction opposite to the first direction, and the source driving circuit is capable of changing an order in which the image signal is output to the plurality of pixel circuits arranged in a row direction on the display panel into either a third direction orthogonal to the first direction or a fourth direction opposite to the third direction.

10. The display device according to claim 5, further comprising:

a rotation mechanism that rotates the display panel.

11. A non-transitory computer-readable recording medium having recorded thereon a program for use in a computer and for detecting a rotation-recommended state of a display panel in which a plurality of pixel circuits each including a light-emitting device are arranged in rows and columns, the program causing the computer to execute:

in a case where the display panel is divided into a plurality of blocks each having the same number of the pixel circuits, detecting a degree of deterioration for each of the plurality of blocks from display history information that is accumulated in an accumulator circuit; and if the number of the plurality of blocks whose degrees of deterioration are greater than or equal to a first threshold value determined in advance is greater than or equal to a predetermined number, detecting that the display panel is in the rotation-recommended state.

12. The non-transitory computer-readable recording medium according to claim 11, wherein the program causes the computer to detect, as the degree of deterioration, a maximum value of accumulated values of the display history information regarding the light-emitting devices for each of the plurality of blocks.

13. The non-transitory computer-readable recording medium according to claim 11, wherein the program causes the computer to calculate, as the degree of deterioration, an average value of a first degree of deterioration for each of the plurality of blocks and a second degree of deterioration for each of the plurality of blocks that overlap respectively with positions of the plurality of blocks when the display panel is rotated in an in-plane direction, and to determine whether the average value calculated is less than or equal to a second threshold value.

14. The non-transitory computer-readable recording medium according to claim 11, wherein the program causes the computer to:

in a case where the computer has detected that the display panel is in the rotation-recommended state, and the display panel is rotated, operate the gate driving circuit to change an order in which a gate signal is output from the gate driving circuit to a plurality of pixel circuits arranged in a column direction on the display panel from a first direction to a second direction opposite to the first direction; and operate the source driving circuit to change an order in which an image signal is output from the source driving circuit to the plurality of pixel circuits arranged in a row direction on the display panel from a third direction orthogonal to the first direction to a fourth direction opposite to the third direction.

* * * * *